US005250992A

United States Patent [19]

Tsuneeda et al.

[11] Patent Number: 5,250,992

[45] Date of Patent: Oct. 5, 1993

[54] IMAGE FORMING APPARATUS HAVING SHARP EDGED ELECTRODE

[75] Inventors: Kenichi Tsuneeda, Yokohama; Yoshiyuki Fukuda, Fujisawa, both of Japan

[73] Assignee: Kabushiki Kaisha Toshiba, Kawasaki, Japan

[21] Appl. No.: 800,019

[22] Filed: Nov. 29, 1991

[30] Foreign Application Priority Data

Nov. 30, 1990 [JP] Japan ..... 2-340527

[51] Int. Cl.[5] ..... G03G 15/02

[52] U.S. Cl. ..... 355/221; 355/224; 361/229

[58] Field of Search ..... 355/219, 221, 224, 225; 361/229; 250/324–326

[56] References Cited

U.S. PATENT DOCUMENTS 3,744,898 7/1973 Kurahashi et al. ..... 355/224

4,835,571 5/1989 Tagawa et al. ..... 355/225

FOREIGN PATENT DOCUMENTS 58-147757 9/1983 Japan ..... 355/224

*Primary Examiner*—Joan H. Pendegrass

*Attorney, Agent, or Firm*—Foley & Lardner

[57] ABSTRACT

An image forming apparatus includes a discharger for discharging a surface of an photoreceptor, a shield case arranged opposite to the photoreceptor and having an opening opposite to the photoreceptor a corona wire electrode arranged in the shield case and connected to a high voltage power source, a charger arranged in the opening of the shield case and having a grid grounded through a constant potential element for charging the photoreceptor surface, and an electrode arranged opposite the photoreceptor between the discharger and the charger and having a sharp edge opposite the photoreceptor. The electrode is grounded through the constant potential element and generates an unbalanced electric field between the electrode and the photoreceptor, thereby discharging charges located on the photoreceptor surface and having a polarity different from that of the electrode.

15 Claims, 9 Drawing Sheets

PREEXPOSURE CHARGE

EXPOSURE

DEVELOPMENT

TRANSFER · SEPARATION

PREEXPOSURE · CHARGE

EXPOSURE · DEVELOPMENT

IMAGE FORMING APPARATUS HAVING SHARP EDGED ELECTRODE

BACKGROUND OF THE INVENTION

1. Field of the Invention

The present invention relates to an image forming apparatus such as an electrophotographic apparatus and a laser printer and, more particularly, to an improvement of a charger in an image forming apparatus.

2. Description of the Related Art

In an image forming apparatus such as an electrophotographic apparatus or laser printer, a corona discharging system has been widely used as a charger for uniformly performing a charging operation on an image bearing member, because the charger has a simple structure and high charging efficiency.

Corona discharging schemes are classified into a corotron in which a high voltage is applied to a corona wire electrode accommodated in a shield case to supply corona ions to an image bearing member from an opening opposite the image bearing member, a scorotron in which a screen-like grid is arranged in an opening opposite to an image bearing member and a predetermined voltage is applied to the grid to control corona ions supplied to the image bearing member.

A laser printer generally employs a scheme in which a negative charge type organic photoconductor (to be referred to as an OPC hereinafter) is used as an image bearing member to generate an image by inversion. Since the OPC must have a charger for discharging negative corona ions having unstable discharging characteristics, a scorotron scheme having excellent stability is conventionally used.

When a charger of this scorotron scheme is used, the charging ability of the charger is structurally determined in consideration of a moving time of an image carrier, the charging characteristics of the image bearing member, and a surface potential of the image bearing member immediately before a charging operation.

In recent years, as the size of an image forming apparatus has decreased, high-speed operation of the image forming apparatus is required by the market. Under these circumstances, the size of a charger must be decreased to accommodate the charger in a limited space. In addition, since a charging time is decreased to shorten a moving time of an image bearing member, a charger must have a high charging ability.

A surface potential of the image bearing member immediately before the charging operation, which potential influences a charging operation, tends to decrease the charging capacity of the charger in an image forming system. That is, a separating means located next to a transfer unit has been changed from a mechanical separating apparatus using a belt or grippers to a corona separating apparatus having a shield case and a corona wire in consideration of installation space and cost. That is, in a discharging separation scheme, a high negative voltage is applied to an electrode having a shape edge using a small curvature obtained by decreasing the diameter of the image bearing member, and corona discharge is generated by an electric field between the electrode having the sharp edge and a transfer medium having transfer charges. Although transfer charges of a transfer medium and an image bearing member ar sufficiently destaticized in this scheme, since the scheme requires a discharging separation transformer, the cost is disadvantageously increased.

In order to keep the cost low, the following scheme is practically used. That is, a discharging lamp or a grounded electrode having a sharp edge is arranged immediately before a transfer unit to weaken an electrostatic attraction force between a transfer medium and an image bearing member, thereby performing a separating operation. In this scheme, it is an object to discharge the transfer medium, in contrast to the above scheme in which the high negative voltage is applied to positively remove positive charges received by a transfer corona apparatus over the entire areas of the transfer medium and the image bearing member. For this reason, this scheme does not have an ability of sufficiently discharging the entire area of the image bearing member. Therefore, after transferring and separating operations, positive charges remaining on the surface of the image bearing member are left through cleaning and preexposing steps, and a discharging operation is not performed in these steps. A charging step is initiated in this state. In the cleaning and preexposing steps, when a negative OPC is used as the image bearing member, only a destaticizing operation of negative charges is performed, but a discharging effect for positive charges cannot be expected.

Therefore, when a charger does not have a sufficiently high negative charge having a polarity opposite to the positive charge of the image bearing member immediately before the charging step, a charging potential is lowered as indicated by $V_0'$ in FIG. 1E of electrostatic processes shown in FIGS. 1A to 1F, and a fog $t'$ causing background scumming occurs due to a potential difference between development biases $V_B$ and $V_0'$ in a developing operation as shown in FIG. 1F. This phenomenon will be described with reference to FIGS. 2A to 2B.

FIGS. 2A and 2B are views showing an image bearing member viewed from a transfer unit side. A region indicated by hatched lines in FIG. 2A is a region of the image bearing member which directly receives positive charges serving as transfer corona ions. A region between transfer media Pl and P2 and regions on both the sides of the image bearing member except for the transfer media receive positive charges. When these regions are charged and developed and are set in the second cycle, as shown in FIG. 2B, background fog occurs in a portion receiving the transfer corona ions to cause image degradation. The background fog and image degradation continuously occur not only in the first and second printing operations but until the end of operation of the transfer unit.

As described above, when a scheme for performing discharging and separating operations of a transfer medium using a grounded electrode having a sharp edge is used for obtaining a simple and low-cost separating scheme, a portion irradiated with the transfer corona is not sufficiently destaticized after a transfer operation. Therefore, even when the surface of the image bearing member is negatively charged in a later charging process, the surface of the image bearing member is not easily controlled to have a predetermined constant potential. For this reason, a potential difference between a charging potential and a developing bias cannot be sufficiently obtained, and background fog occurs. Therefore, a toner is always attracted to a region of the image bearing member surface except for portions covered with transfer media. Since the toner is removed by a cleaner, print cost is increased by an increase in consumption amount of the toner, an insufficient capacity of the cleaner is caused, and contamination in the machine occurs.

In addition, since a sufficiently high charging potential cannot be obtained between sheets, i.e., a sheet interval, due to an influence of the above transfer corona, image degradation such as background fog disadvantageously occurs as an electrostatic memory on a print image.

SUMMARY OF THE INVENTION

It is an object of the present invention to provide an image forming apparatus comprising a charging device capable of uniformly and stably controlling a surface potential of an image bearing member even when a surface potential of an image bearing member surface region except for a portion covered with a transfer medium is a potential opposite to a charging potential.

According to an aspect of the present invention, there is provided an image forming apparatus comprising: discharging means for discharging a surface of an image bearing member; means for charging the surface of the image bearing member to have a first potential; and an electrode member having a sharp edge, arranged opposite to the image bearing member between the image bearing member and the electrode member.

According to another aspect of the present invention, there is provided an image forming apparatus comprising: discharging means for discharging a surface of an image bearing member; means for charging the surface of the image bearing member, the charging means including a shield case having an opening opposite to the image bearing member, a corona wire electrode arranged in the shield case and connected to a high-voltage power source, and a grid arranged in the opening of the shield case and grounded through a constant potential element; and an electrode member having a sharp edge opposite to the image bearing member, arranged opposite to the image bearing member between the discharging means and the charging means, and grounded through the constant potential element, the electrode member generating an unbalanced electric field between the electrode member and image bearing member.

According to still another aspect of the present invention, there is provided an image forming apparatus comprising: discharging means for discharging a surface of the photoreceptor; means for charging the surface of the image bearing member, the charging member including a shield case having a first opening opposite the image bearing member and a second opening on the discharging means side, a corona wire electrode arranged in the shield case and connected to a high-voltage power source, and a grid arranged in the opening of the shield case and grounded through a constant potential element; and an electrode member arranged opposite to the image bearing member between the discharging means and the charging means, insulated from the shield case so as to cover the second opening, grounded through the constant potential element, and having a sharp edge opposite the image bearing member.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

In an image forming apparatus according to the present invention, an electrode having a sharp edge is arranged opposite to an image bearing member (photoreceptor) between a discharging means and a charging means.

When the charging means is a scorotron charger, negative corona ions generated by a discharging operation of a corona wire performed by applying a high voltage thereto flow into a shield case and a grid. As a result, the potentials of the shield case and grid are increased to a predetermined breakdown voltage of a Zener diode. When the electrode having the sharp edge is electrically connected to the shield case and the grid, the potential of the electrode having the sharp edge is increased in the same manner as described above. For this reason, all the potentials of the shield case, the grid, and the electrode having the sharp edge are kept at a predetermined potential.

A positive transfer corona applied through a transfer medium has positive charges in a transferred corona irradiated portion except for a portion corresponding to the transfer medium. The positive charges cannot be discharged and removed by even a ground discharging needle of a separating means and cannot be discharged by an optical discharging means located next to a cleaner. After the positive charges pass through the optical discharging means, the positive charges on a photoreceptor generate a strong unbalanced electric field between the photoreceptor and the electrode having the sharp edge. In the presence of the strong unbalanced electric field, a gas near the electrode having the sharp edge can be sufficiently ionized, and the positive charges on the photoreceptor can be discharged by corona ions generated by this ionization.

When the positive charges on the photoreceptor are sufficiently discharged and erased, a charger performs a sufficient charging operation within its capacity. As a result, the photoreceptor can be controlled to have a charging potential predetermined by the charger.

Therefore, since a sufficient potential difference between a charging potential and a developing bias can be obtained, background fog does not occur, and the image forming apparatus according to the present, invention can prevent an increase in printing costs by an increase in toner consumption, a lack of cleaner capacity of and contamination in the apparatus.

The electrode having the sharp edge and used in the present invention is an electrode having a sharp edge opposite to a photosensitive body. The sharp edge preferably has a size (diameter or thickness) of 50 μm or less. As the sharp edge, a saw-toothed, brush-like, or wire-like sharp edge is used.

An embodiment of the present invention will be described with reference to the accompanying drawings.

Figure 1A:
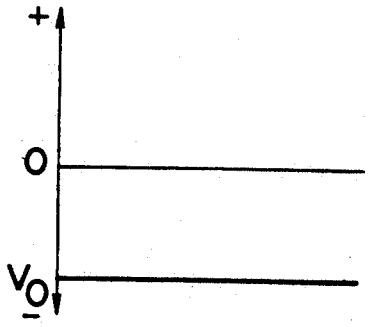
FIGS. 1A to 1F are views showing electrostatic processes; processes.
Figure 1B:
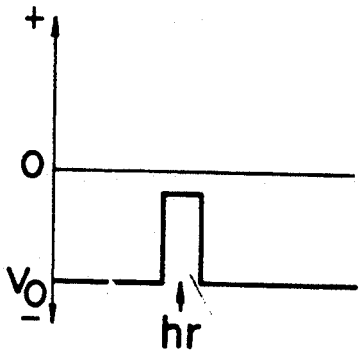
Figure 1C:
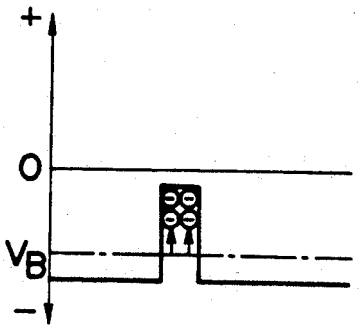
Figure 1D:
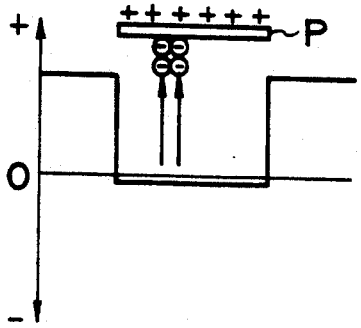
Figure 1E:
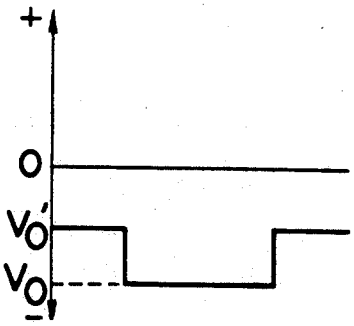
Figure 1F:
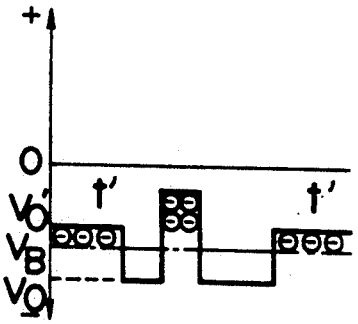
Figure 2A:
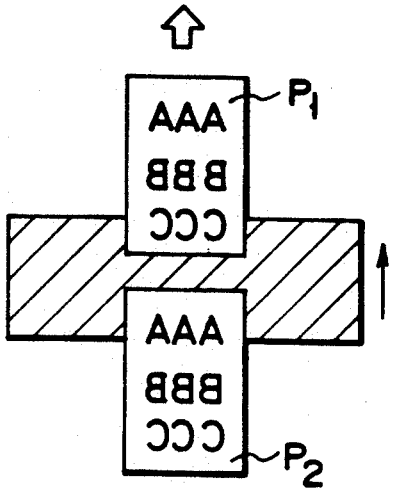
FIGS. 2A and 2B are views for explaining problems of a conventional apparatus.
Figure 2B:
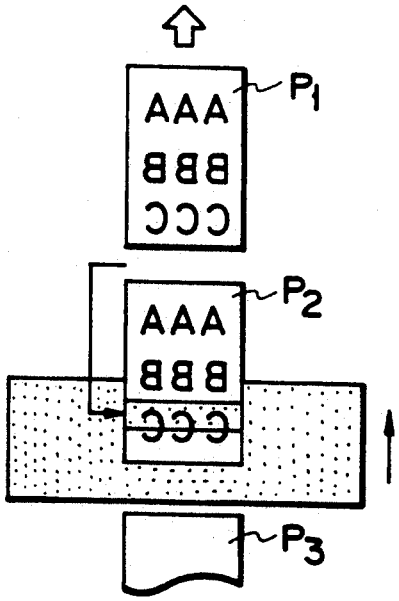
Figure 3:
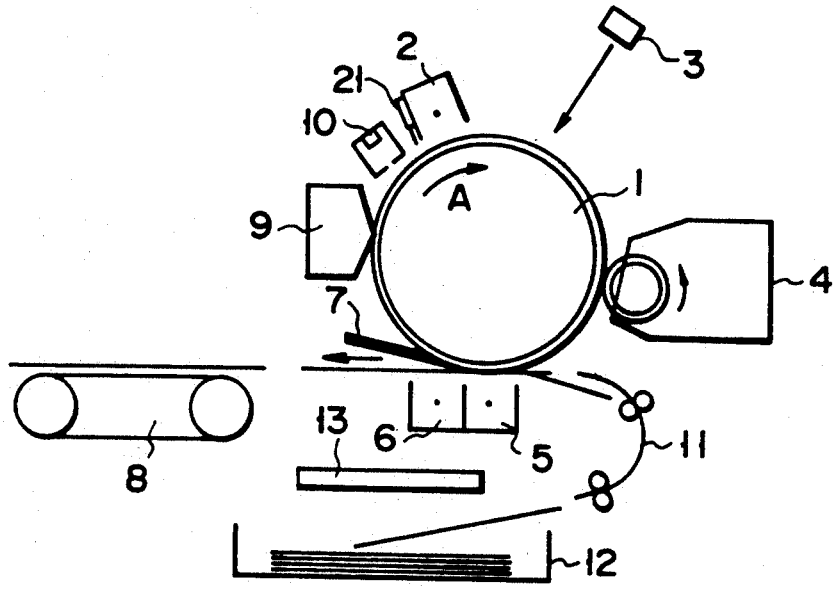
FIG. 3 is a sectional view schematically showing a copying machine serving as an image forming apparatus according to the first embodiment of the present invention.

FIG. 3 is a view schematically showing an arrangement of a copying machine serving as an image forming apparatus according to the embodiment of the present invention. In FIG. 3, reference numeral 1 denotes a photosensitive drum as a photoreceptor. A scorotron charger 2 with an electrode 21 having a sharp edge, an exposing unit 3, a developing unit 4, a corotron transfer charger 5, a separating charger 6 constituted by an electrode having a sharp edge, separating grippers 7, a post-transfer convey portion 8, a cleaner 9, and a preexposing unit 10 are arranged clockwise around the photosensitive drum 1. A cassette 12 for storing transfer sheets 11 is arranged below the photosensitive drum 1. Note that reference numeral 13 denotes a pretransfer convey portion for conveying a transfer sheet from the cassette 12 to the photosensitive drum 1.

Figure 4:
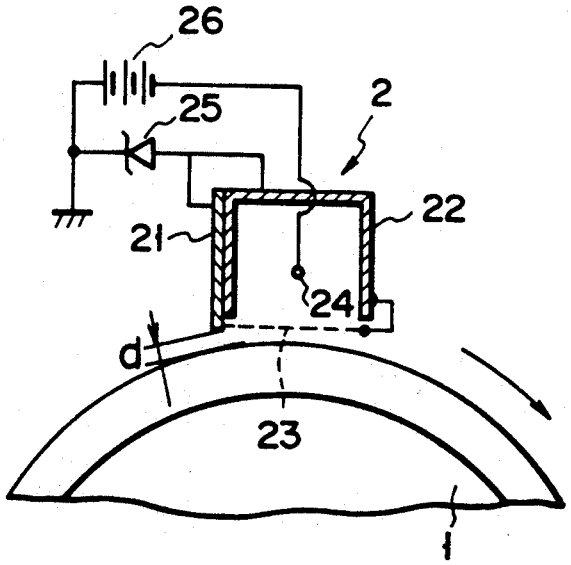
FIG. 4 is a view showing an arrangement near a charger according to the first embodiment of the present invention.

FIG. 4 shows the scorotron charger 2 in the copying machine shown in FIG. 3. In FIG. 4, the charger 2 is constituted by a shield case 22, a grid 23, and corona wire 24. The electrode 21 having the sharp edge is arranged on the upstream side of the shield case 22. The shield case 22 is electrically connected to the grid 23 and the electrode 21 having the sharp edge, and the shield case 22 is grounded through a Zener diode 25 having a breakdown voltage of about −610 V. A high voltage of about −5.5 kV is applied from a high-voltage transformer 26 to the corona wire 24.

Figure 5:
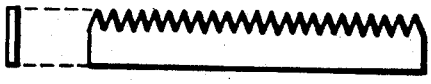
FIG. 5 is a view showing a shape of an electrode having a sharp edge.

The electrode 21 having the sharp edge is arranged to be close to the photosensitive drum 1 on the upstream side of the charger 2 to have a gap $d_1$ of about 1 to 3 mm between the electrode 21 and the photosensitive body 1. The electrode 21 having the sharp edge is opposite to the photosensitive drum 1. The electrode 21 having the sharp edge is obtained by etching a stainless plate having a thickness of 0.1 mm to have saw teeth, as shown in FIG. 5. The pitch of the saw teeth is 1.0 mm.

When the high voltage of −5.5 kV is applied from the high-voltage transformer 26 to the corona wire 24, a current flows through the shield case 22, the grid 23, and the electrode having the sharp edge by a corona discharge, and a voltage having about −610 V is applied to the apparatus by the Zener diode 25. Corona ions generated from the corona wire 24 charge the surface of the photosensitive drum through a screen-like opening of the grid 23. A strong unbalanced electric field is generated between the electrode 21 having a sharp edge 21 and the photosensitive drum 1 in correspondence with the charges on the surface of the photosensitive drum 1. As a result, corona ions are generated near the electrode 21 having the sharp edge, and the positive charges on the photosensitive drum 1 are destaticized by the corona ions.

An operation of the above-described copying machine will be described in detail with reference to FIGS. 3 and 4.

A toner image formed on the photosensitive drum 1 by the developing unit 4 is transferred on the sheet 11 by the transfer charger 5. The sheet 11 having the toner image is separated from the photosensitive drum 1 due to the size of the curvature of the photosensitive drum 1 and a decrease in an electrostatic attraction force generated between the photosensitive drum 1 and the sheet 11 by the electrode having the sharp edge of the separating charger 6, and the sheet 11 is discharged through a fixing unit.

A toner remaining on the photosensitive drum 1 after the transferring operation is cleaned by the cleaner 9, but the positive charges on the photosensitive body directly irradiated with the transfer corona without being through the sheet 11 pass through the cleaner 9 and go to the preexposing unit 10. Although a negatively charged portion of the photosensitive drum 1 having a negative polarity is discharged by the preexposing unit 10, the positive charges go to the electrode 21 having the sharp edge without being destaticized by the preexposing unit 10. In this case, an unbalanced potential is generated by a surface potential of about +1,000 V on the photosensitive drum 1 and the voltage of −610 V applied to the electrode 21 having the sharp edge, and corona ions are generated by ionizing the gas, thereby rapidly discharging the positive charges on the photosensitive drum.

Due to this discharging effect, negative charges for performing a discharging operation need not be applied to the positively charged photosensitive drum 1, and a predetermined negative charging operation can be sufficiently performed on the photosensitive drum 1 within a predetermined charging time.

Figure 6:
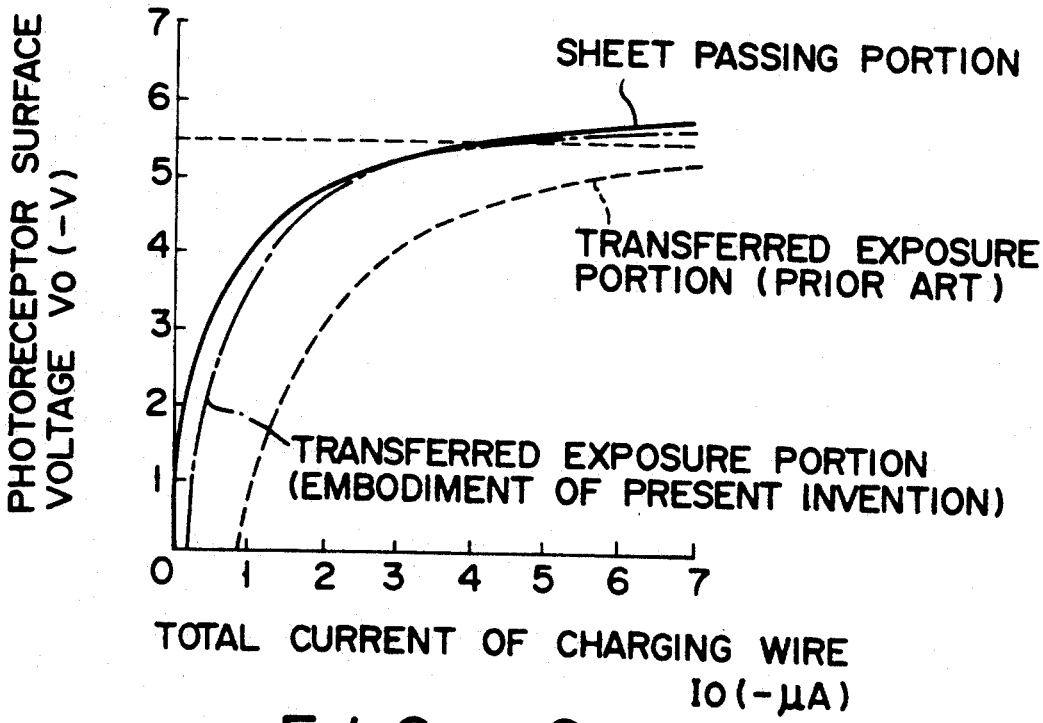
FIG. 6 is a graph showing an effect of the present invention.
Figure 7:
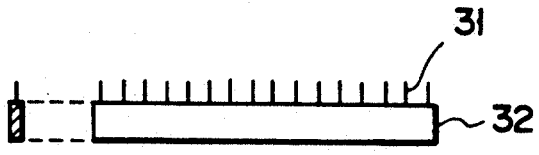
FIGS. 7 and 8 are views showing other electrodes having sharp edges.

FIG. 6 is a graph in which a total current $I_0$ of the charged wire is plotted along the abscissa and a photosensitive body surface potential $V_0$ is plotted along the ordinate. In FIG. 6, a solid line indicates the potential of a sheet passing portion, a broken line indicates the potential of a transfer-exposed portion of a conventional technique, and alternate long and short dash lines indicates the potential of a transfer-exposed portion of this embodiment. The following will be apparent from the graph in FIG. 6. That is, the photo-sensitive body surface potential $V_0$ the sheet passing portion is controlled to be a charge potential of about −550 V by increasing the total current $I_0$. However, according to a conventional charger, even when the total current $I_0$ is increased on the transfer-exposed portion, since a potential difference between the transfer-exposed portion and the sheet passing portion is large, the potential difference remains as an electrostatic memory. Therefore, under these circumstances, the potential difference is not eliminated until the total current $I_0$ is set to be 1 mA or more. Since the current having such a large current amount causes the negative corona to exhaust a very large amount of ozone, this current cannot be used from the viewpoint of safety.

In contrast to this, in the image forming apparatus of this embodiment, the charging property of the transfer-exposed portion is almost equal to that of the sheet passing portion. Therefore, excellent charging property can be obtained without background fog.

In the above-described embodiment, although the electrode 21 having a sharp edge is made of stainless steel, other metals can be used for the electrode 21. In addition, the electrode 21 having the sharp edge may have a saw-toothed shape as shown in FIG. 5, and the electrode 21 may be formed such that metal fiber bundles 31 each of which is obtained by binding about 100 stainless fibers each having a diameter of, e.g., about 20 μm, are planted in a meal plate 32 with a predetermined interval. Synthetic fibers such as rayon or nylon containing carbon can be used in place of the metal fibers.

Figure 8:
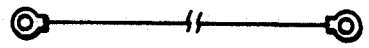
Figure 9:
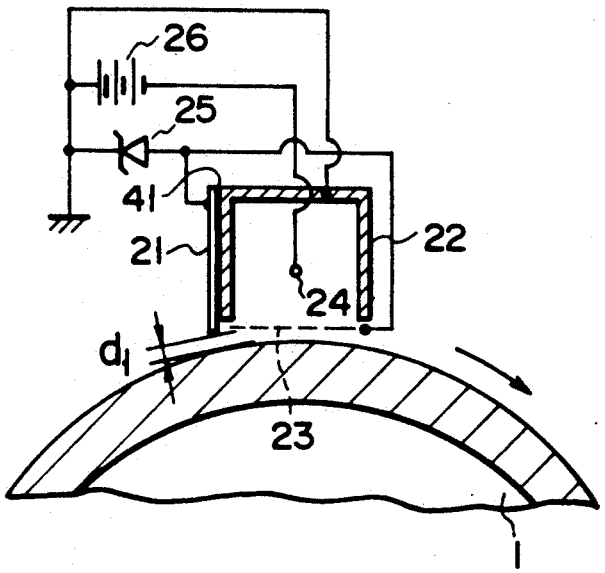
FIGS. 9 to 11 are views showing modifications of the apparatus shown in FIG. 4.

As shown in FIG. 8, a metal thin wire having a diameter of several tens microns which is similar to a corona wire can be used as the electrode 21.

In the embodiment shown in FIG. 4, the shield case 22 is electrically connected to the grid 23 and the electrode 21 having the sharp edge, and the shield case is grounded through the Zener diode 25. However, the shield case 22 may be directly grounded. In this case, the electrode 21 having the sharp edge is insulated from the shield case 22 by an insulating member 41.

Figure 10:
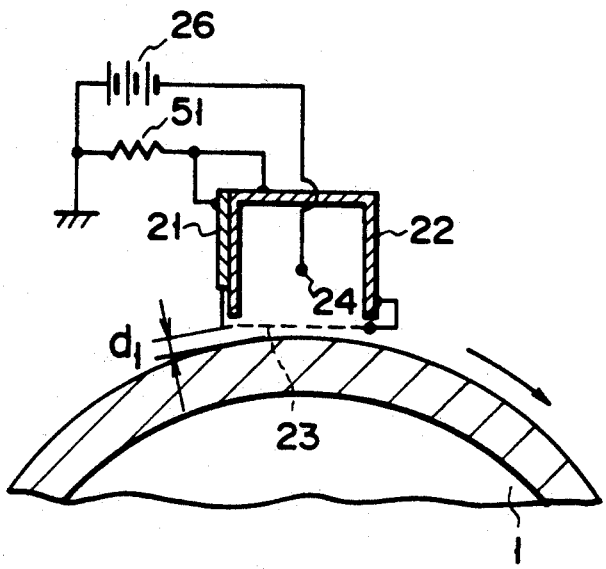

In the embodiment shown in FIG. 4, the Zener diode is used as a means or applying a self-bias to the shield case 22 and the grid 21. However, as shown in FIG. 10, even if a resistive element 51 is used in place of the Zener diode, the same effect as described above can be obtained.

Figure 11:
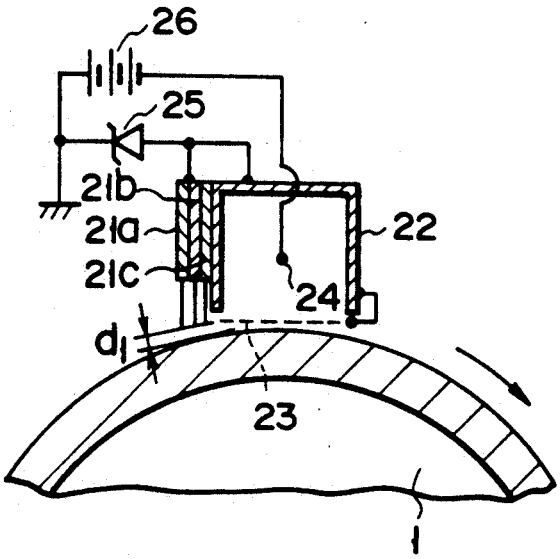

The electrode 21 having the sharp edge may be arranged at any position between the preexposing unit and the charger 2. As shown in FIG. 11, a plurality of electrodes 21*a*, 21*b*, and 21*c* each having a sharp edge may be arranged. The electrode 21 having the sharp edge may be arranged to have a predetermined interval with the photosensitive drum 1 or arranged to be in contact with the photosensitive drum 1.

Figure 12:
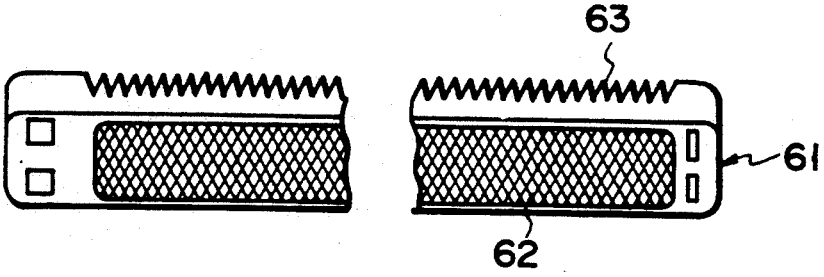
FIG. 12 is a view showing a grid having an electrode having a sharp edge used in the second embodiment of the present invention.
Figure 13:
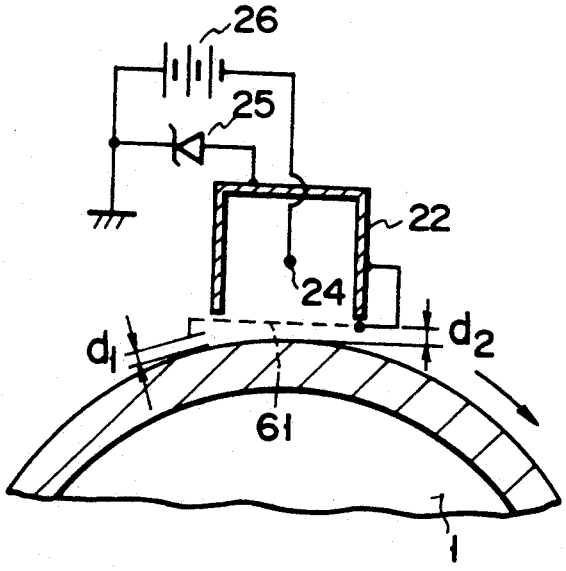
FIG. 13 is a view showing an arrangement near a charger according to the second embodiment of the present invention.
Figure 14:
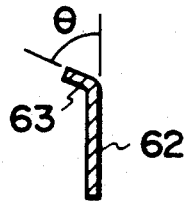
FIG. 14 is a sectional view showing a grid having an electrode having a sharp edge used in the second embodiment of the present invention.

FIG. 13 shows another embodiment of the present invention. That is, although the electrode 21 having the sharp edge is arranged on the shield case 22 of the charger 2 in the embodiment in FIG. 4, an electrode having a sharp edge may be integrally formed with a grid represented by reference numeral 61 in FIG. 13. As shown in FIG. 12, a stainless plate having a thickness of 0.1 mm is processed by etching to form a screen mesh 62 having a large number of hexagonal openings and a saw-toothed electrode 63, and the resultant structure is bent as shown in FIG. 14. This electrode can be arranged as shown in FIG. 13. According to this embodiment, the same effect as shown in FIG. 6 can be obtained.

Figure 15:
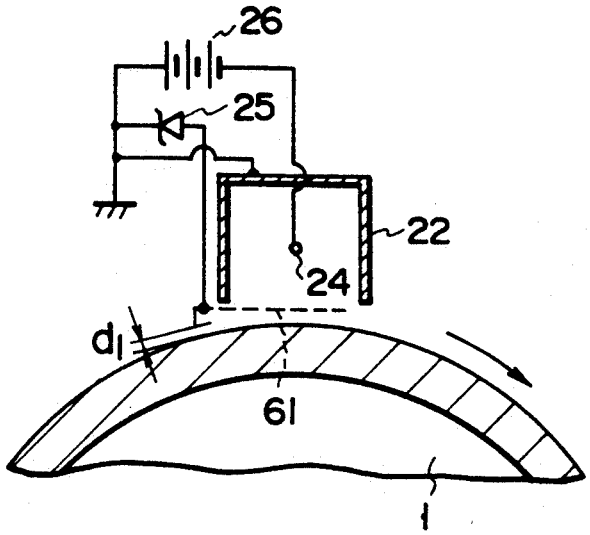
FIGS. 15 and 16 are views showing modifications of the apparatus shown in FIG. 13.

In the embodiment shown in FIG. 13, the shield case 22 and the grid 61 including the electrode having the sharp edge are connected to each other to have the same potential. However, as shown in FIG. 15, a self-bias may be applied only the grid 61 including the electrode having the sharp edge such that the shield case 22 and the grid 61 are separated from each other and the shield case 22 is grounded.

Figure 16:
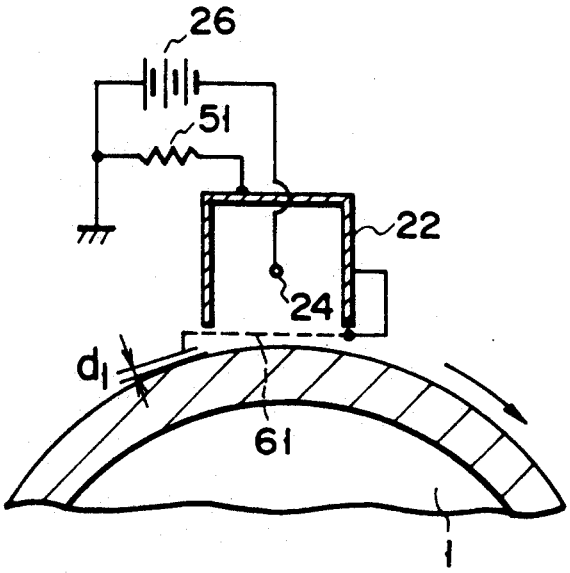

In the embodiments shown in FIGS. 13 and 16, FIG. 16, even if a resistive element 51 is used in place of a Zener diode, the same effect as shown in FIG. 4 can be obtained.

Figure 17:
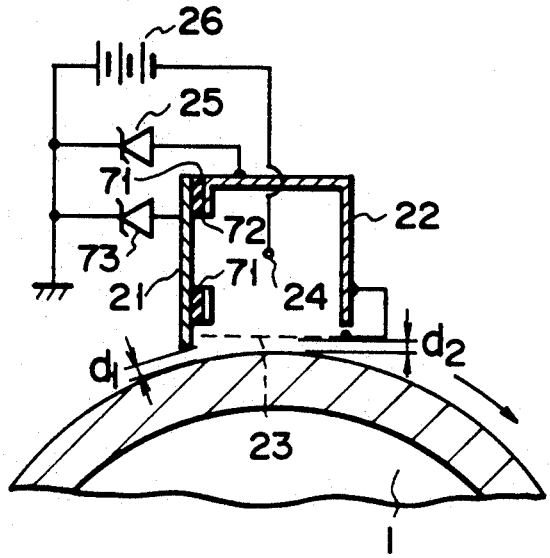
FIG. 17 is an arrangement near a charger according to the third embodiment of the present invention.

FIG. 17 shows still another embodiment of the present invention. An opening is formed in a part of a side plate on the upstream side of a shield case 22, and an electrode 21 having a sharp edge is arranged through an insulating member 71. With the above structure, the electrode 21 having the sharp edge can receive corona ions through an opening 72. The electrode 21 having the sharp edge is grounded through a Zener diode 73 having a breakdown voltage of about −1,000 V.

In the structure shown in FIG. 17, when a high voltage is applied to a corona wire 24, a current generated by a corona discharge flows in the shield case 22, a grid 23, and the electrode 21 having the sharp edge so as to generate a voltage of about −610 V at the shield case 22 and the grid 23 by a Zener diode 25 and generate a voltage of about −1,000 V at the electrode 21 having the sharp edge. The corona ions generated from the corona wire 24 charge the surface of a photosensitive drum 1 through screen-like openings of the grid 23. An unbalanced electric field is generated between the electrode 21 having the sharp edge and the photosensitive drum 1 in correspondence with to the charges on the surface of the photosensitive drum 1.

Figure 18:
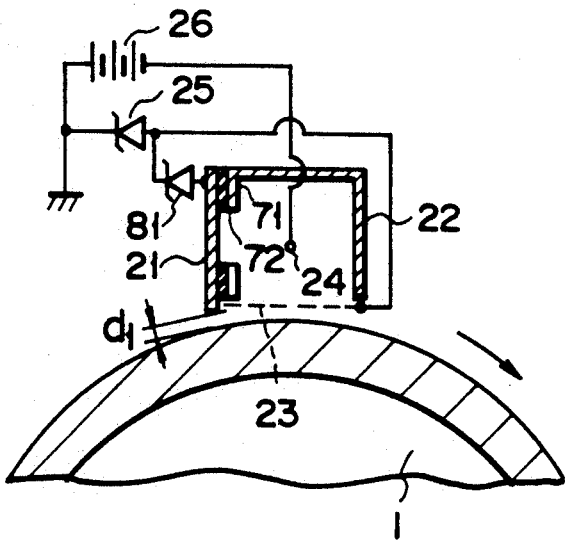
FIG. 18 is a view showing a modification of the apparatus shown in FIG. 15.

In this embodiment, as shown in FIG. 18, the electrode 2 having the sharp edge may be electrically connected to the shield case 22 through a Zener diode 81, and a voltage generated by the grid 23 may be separated from a voltage generated from the shield case 22 and the electrode 21 having the sharp edge, such that a high voltage is generated at the electrode 21 having the sharp edge.

In this embodiment, as shown in FIGS. 10 and 16, a resistive element can be used in place of the Zener diode connected to the shield case 22.

As described above, according to the image forming apparatus of the present invention, an excellent image can be formed free from image degradation caused by background fog, an increase in print cost caused by an increase in toner consumption, a lack of a capacity for toner, contamination in a machine, and production of a large amount of ozones.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image forming apparatus comprising:

discharging means for discharging a surface of an image bearing member;

means for charging the surface of said image bearing member to have a first potential; and an electrode member having a sharp edge, arranged opposite to said image bearing member between said discharging means and said charging means, and have a second potential, for forming an unbalanced electric field between said image bearing member and said electrode, wherein said electrode is arranged to have an interval of 1 to 3 mm with said image bearing member.

2. An image forming apparatus comprising:

discharging means for discharging on a surface of an image bearing member;

means for charging the surface of said image bearing member, said charging means including a shield case having an opening opposite to the image bearing member, a corona wire electrode arranged in said shield case and connected to a high-voltage power source, and a grid arranged in said opening of said shield case and grounded through a constant potential element; and an electrode member having a sharp edge opposite to said image bearing member, arranged opposite to said image bearing member between said discharging means and said charging means, and grounded through said constant potential element, said electrode member generating an unbalanced electric field between said electrode and image bearing member.

3. An apparatus according to claim 2, wherein said electrode member is mounted on said shield case.

4. An apparatus according to claim 2, wherein said electrode member is integrally formed with said grid.

5. An apparatus according to claim 2, wherein said sharp edge of said electrode member has a saw-toothed shape.

6. An apparatus according to claim 2, wherein said sharp edge of said electrode member has conductive fibers.

7. An apparatus according to claim 2, wherein said electrode member has a metal wire.

8. An apparatus according to claim 2, wherein said constant potential element has a Zener diode.

9. An apparatus according to claim 2, wherein said constant potential element has a resistive element.

10. An image forming apparatus comprising:

discharging means for discharging a surface of an image bearing member;

means for charging the surface of the image bearing member, said charging means including a shield case having a first opening opposite to the image bearing member and a second opening on said discharging means side, a corona wire electrode arranged in said shield case and connected to a high-voltage power source, and a grid arranged in said first opening of said shield case and grounded through a constant potential element; and an electrode member arranged opposite to said image bearing member between said discharging means and said charging means so as to cover said second opening and insulated from said shield case, said electrode member grounded through said constant potential element and having a sharp edge opposite to said image bearing member.

11. An apparatus according to claim 10, wherein said sharp edge of said electrode member has a saw-toothed shape.

12. An apparatus according to claim 10, wherein said sharp edge of said electrode member has conductive fibers.

13. An apparatus according to claim 10, wherein said electrode has a metal wire.

14. An apparatus according to claim 10, wherein said constant potential element has a Zener diode.

15. An apparatus according to claim 10, wherein said constant potential element has a resistive element.

* * * * *